US007048308B2

(12) United States Patent
Blank

(10) Patent No.: US 7,048,308 B2
(45) Date of Patent: May 23, 2006

(54) EXCISABLE PHARMACEUTICAL LABEL

(75) Inventor: Paul C. Blank, LaCrosse, WI (US)

(73) Assignee: NCR Corporation, Dayton, OH (US)

( * ) Notice: Subject to any disclaimer, the term of this patent is extended or adjusted under 35 U.S.C. 154(b) by 297 days.

(21) Appl. No.: 10/407,485

(22) Filed: Apr. 4, 2003

(65) Prior Publication Data

US 2004/0195824 A1 Oct. 7, 2004

(51) Int. Cl.
*B42D 15/00* (2006.01)

(52) U.S. Cl. ..... 283/81; 283/98; 283/100; 283/101; 283/105; 428/40.1; 428/41.8; 428/42.2; 428/42.3; 206/459.5; 40/638

(58) Field of Classification Search ..... 283/81, 283/98, 100, 101, 105; 428/40.1, 41.8, 42.2, 428/42.3; 206/459.5; 40/638
See application file for complete search history.

(56) References Cited

U.S. PATENT DOCUMENTS

| | | | | |
|---|---|---|---|---|
| 3,484,976 | A | 12/1969 | Shea | |
| 4,312,523 | A | 1/1982 | Haines | |
| RE30,958 | E | 6/1982 | White | |
| 5,022,526 | A | 6/1991 | Crum | |
| 5,071,167 | A | 12/1991 | O'Brien | |
| 5,284,689 | A | 2/1994 | Laurash et al. | |
| 5,449,201 | A * | 9/1995 | Miller et al. | 283/79 |
| 5,482,753 | A | 1/1996 | Langan et al. | |
| 5,591,290 | A | 1/1997 | Walter et al. | |
| 5,704,650 | A * | 1/1998 | Laurash et al. | 283/81 |
| 5,874,142 | A * | 2/1999 | Hoffmann | 428/40.1 |
| 5,900,610 | A * | 5/1999 | Kelly, Jr. | 235/385 |
| 5,958,536 | A * | 9/1999 | Gelsinger et al. | 428/40.1 |
| 6,110,554 | A | 8/2000 | Moeller et al. | |
| 6,596,359 | B1 * | 7/2003 | Roth et al. | 428/40.1 |
| 6,905,747 | B1 * | 6/2005 | Auchter et al. | 428/40.1 |
| 2002/0106494 | A1 * | 8/2002 | Roth et al. | 428/198 |
| 2004/0007557 | A1 * | 1/2004 | Maliszewski et al. | 215/365 |

FOREIGN PATENT DOCUMENTS

| | | | |
|---|---|---|---|
| AU | 200191339 | B1 * | 4/2002 |
| EP | 1073032 | A1 * | 1/2001 |
| EP | 1229509 | A2 * | 8/2002 |

OTHER PUBLICATIONS

NCR Corporation, "Walgreens" Pharmaceutical Label Laminate, on sale in United States before Jan. 2002, single page, 8.5 by 14 inches.
NCR Corporation, "Walgreens" Pharmaceutical Label Laminate, on sale in United States before Jan. 2002.

* cited by examiner

*Primary Examiner*—Boyer Ashley
*Assistant Examiner*—Mark Henderson
(74) *Attorney, Agent, or Firm*—Francis L. Conte

(57) ABSTRACT

A pharmaceutical script includes a face sheet laminated to a liner by an adhesive therebetween. The face sheet includes a removable label defined by a perimeter diecut. The label includes an excisable tab spaced inboard from a surrounding rim. The tab includes a slit along one edge thereof. And, the label and tab are removable together from the liner to expose adhesive on the label rim, without adhesive being exposed on the tab.

19 Claims, 5 Drawing Sheets

EXCISABLE PHARMACEUTICAL LABEL

BACKGROUND OF THE INVENTION

The present invention relates generally to label forms, and, more specifically, to pharmaceutical label scripts.

Pharmaceutical label scripts are custom made for individual pharmacies for use in completing a typical pharmaceutical drug transaction. The typical pharmacy dispenses prescription drugs in high volume for a large number of individual customers in each business day. The individual pharmacy scripts are tailored for completing an individual prescription transaction, and include one or more pressure sensitive labels for placement on the prescription drug container, which may have any suitable form such as a small plastic bottle. The script typically also includes small warning labels which may also be placed on the bottle. And, the script also includes a receipt and use instructions pertaining to the specific pharmaceutical drug being dispensed.

The high volume usage in pharmaceutical sales requires efficiency and ease of use of the scripts. A typical script is in the form of a single sheet which may be conveniently fed into a printer, such as a laser printer, for printing thereon all required information for completing the pharmaceutical transaction. Since a laser printer includes a hot fusion roller, the script must be configured with suitable pressure sensitive adhesive that is not excessively heat-softened during its travel through the printer for preventing premature delamination of the labels inside the printer, or liberation of heat-softened adhesive from the script during printer travel which could jam or damage the printer.

The various script labels applied to the drug container typically use a permanent bonding, pressure sensitive adhesive to ensure a permanent bond of the labels to the container to prevent their inadvertent or intentional removal therefrom. Permanent labels ensure the correspondence between the actual prescription drugs found in the container with the description and identification thereof on the label.

However, when the drug container is empty of its contents the prescription label remains attached thereto. That label includes confidential or sensitive information regarding the drugs, which the customer may prefer to maintain confidential. However, it is extremely difficult, if not impossible, to readily remove the drug label from the container once it has been adhesively bonded thereto. This creates a problem in discarding the empty container without the confidential information remaining thereon.

Accordingly, it is desired to provide an improved pharmaceutical label script which may be permanently adhered to a prescription drug container, yet permits easy removal of confidential information from the container.

BRIEF SUMMARY OF THE INVENTION

A pharmaceutical script includes a face sheet laminated to a liner by an adhesive therebetween. The face sheet includes a removable label defined by a perimeter diecut. The label includes an excisable tab spaced inboard from a surrounding rim. The tab includes a slit along one edge thereof. And, the label and tab are removable together from the liner to expose adhesive on the label rim, without adhesive being exposed on the tab.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
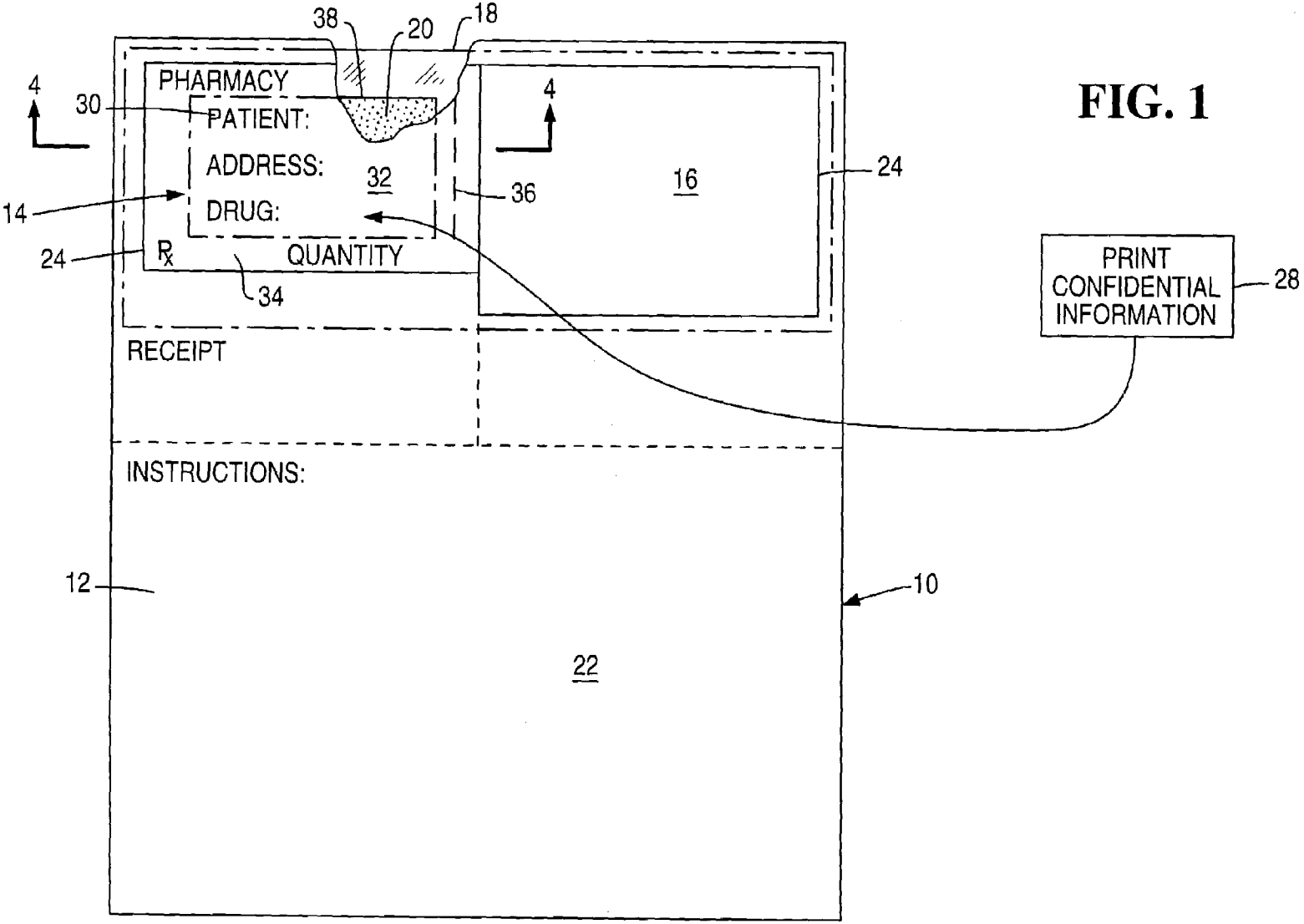
FIG. 1 is a partly sectional front view of a pharmaceutical label script in accordance with an exemplary embodiment.
Figure 2:
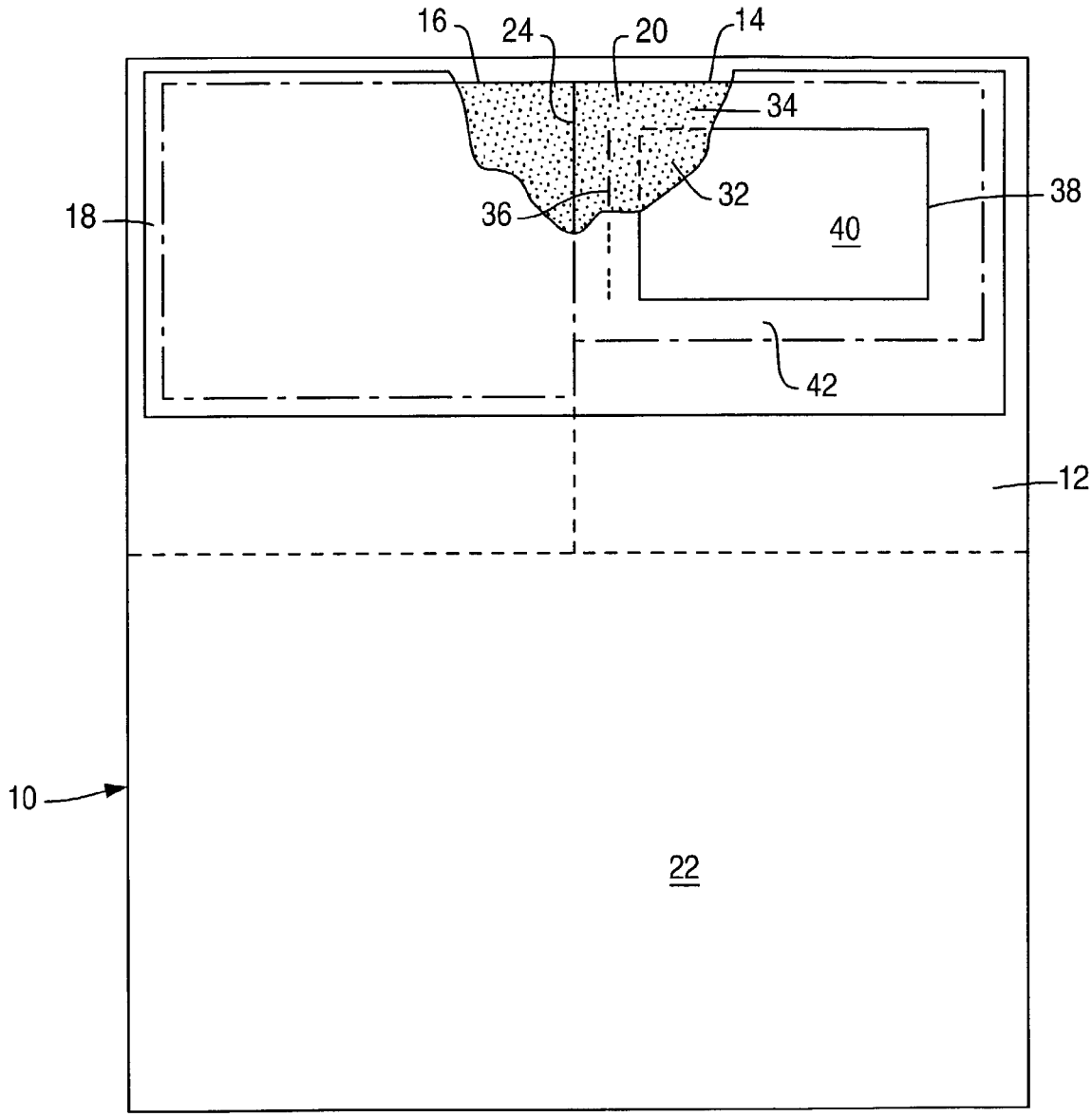
FIG. 2 is a partly sectional back side view of the script illustrated in FIG. 1.

FIG. 1 illustrates the front side of a pharmaceutical label script 10, and FIG. 2 illustrates the back side thereof. The script 10 is a laminate including a unitary or one-ply face sheet 12 having a plurality of removable labels 14,16 laminated to a common release liner 18 by a pressure sensitive adhesive 20 therebetween. In the exemplary embodiment illustrated, the face sheet also includes a lower portion in the configuration of a rectangular form sheet 22 extending below the laminated labels and liner. The script is two-ply at the laminated labels and small liner, and is single-ply therebelow in the form sheet.

A main label 14 and a secondary label 16 are illustrated in FIG. 1 for example only, and the face sheet would typically have several more smaller labels (not shown) for use in the completing the typical pharmaceutical sales transaction. Correspondingly, the form sheet 22 has different portions upon which a receipt may be printed for the customer, and suitable use instructions may be also printed. The form sheet may include lines of perforations or microperforations extending thereacross for permitting convenient tearing of the different sections thereof from the laminated labels.

Each of the labels illustrated in FIG. 1 is defined by a perimeter diecut 24 which permits its individual removal from the surrounding face sheet and underlying liner without tearing. Each label may have printed thereon any suitable information as required for the pharmaceutical transaction.

Figure 3:
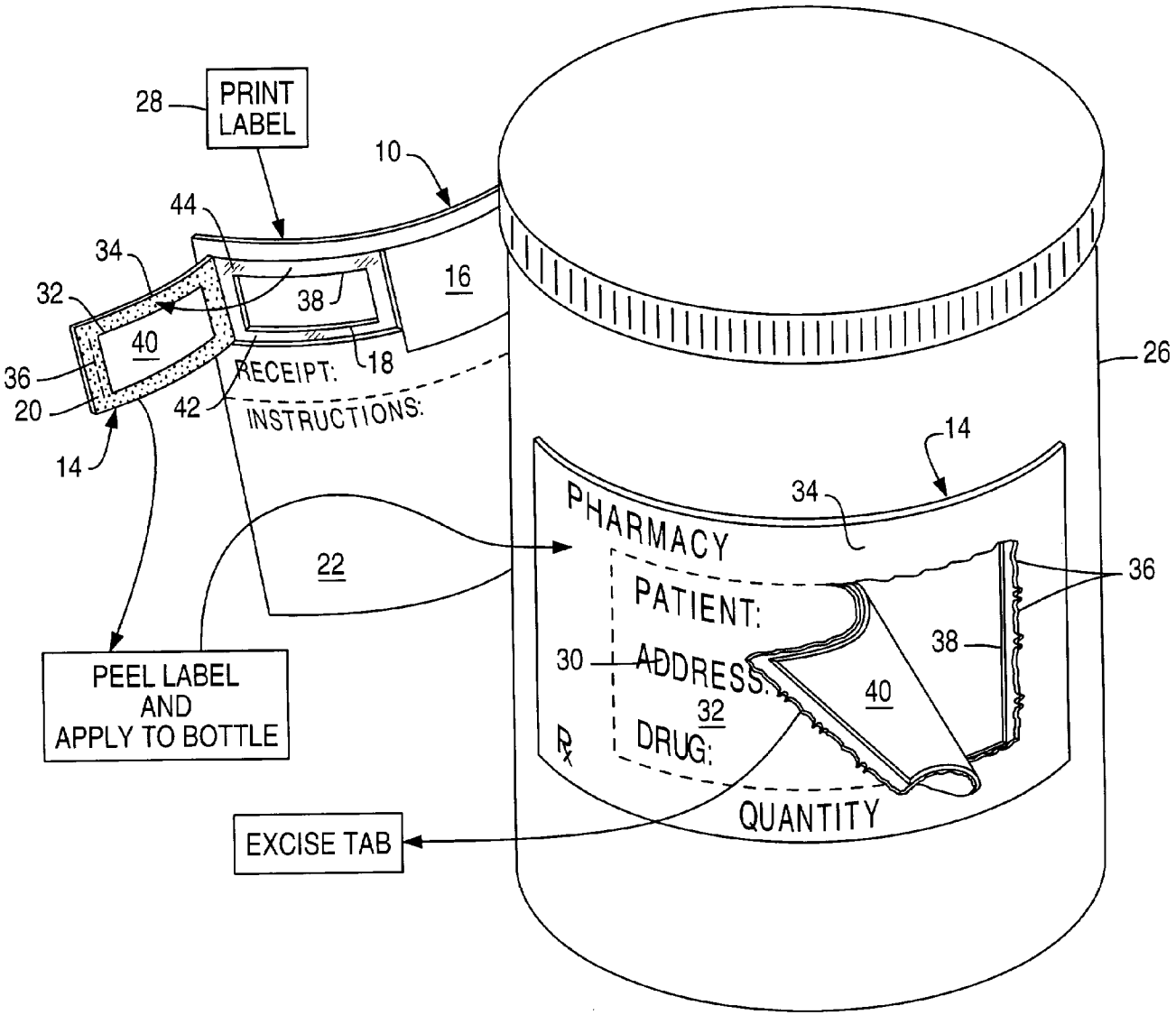
FIG. 3 is an isometric view of the script illustrated in FIGS. 1 and 2 in a preferred method of use for removing and attaching a pharmaceutical label to a drug container.

In the exemplary embodiment illustrated in FIG. 1, the main label 14 is specifically configured for being removed from the script and attached to a pharmaceutical drug container 26 as illustrated in FIG. 3. The container may have any conventional configuration, such as the typical plastic bottle illustrated.

The pharmaceutical script illustrated in FIGS. 1–3 is specifically configured for completing the typical pharmaceutical sales transaction in a pharmacy. A stack of the scripts 10 are typically loaded into a printer, such as a laser printer 28 illustrated schematically in FIGS. 1 and 3 for printing patient confidential information 30 on the exposed front side of the main label 14. Typical confidential or sensitive patient information includes the patient's name, address, and identification of the specific drug being dispensed in the container 26.

In order to maintain the confidentiality of the patient's information 30, the main label includes an integral central tab 32 spaced inboard from a surrounding integral rim or frame 34 as illustrated in FIGS. 1–3. The central label tab 32 is specifically configured for receiving the confidential information 30 on its front side, and being removable or excisable from the label rim after the main label is attached to the drug container. Tab removal is assisted by providing one or more diecut slits 36 along preferably a single one of the edges of the tab.

As shown in FIG. 3, the main label 14 and its tab 32 are initially removable together from the liner 18 to expose the adhesive 20 on the back side of the label rim, without adhesive being exposed on the back side of the tab.

In an exemplary method of use, the laser printer 28 is first used for printing all required information on the face sheet 12, with the confidential information 30 being printed on the front side of the label tab 32. The main label 14 and its printed tab 32 are then removed together from the liner by being simply peeled away therefrom in the typical manner. The so-removed main label is then adhered to the pharmaceutical container 26 illustrated in FIG. 3 using the exposed adhesive 20 around the label rim. The face side of the main label 14 and its central tab 32 expose to view all suitable printed information, including the desired confidential information 30.

When use of the container 26 is completed, with all the prescribed drugs being emptied therefrom, the container may be suitably discarded, but firstly the confidential information 30 may be removed from the container by simply excising or tearing away the printed tab 32 from the label rim 34 which rim remains permanently bonded to the container. The provided slits 36 in the main label provide a convenient manner for initiating tearing of the label tab 32 from the remaining label rim.

In the preferred embodiment illustrated in FIGS. 1–3, the liner 18 includes a corresponding diecut 38 spaced inboard from the perimeter of the liner to define a central liner tab 40 and surrounding liner rim 42. The liner tab 40 is laminated to and corresponds substantially in size and configuration with the label tab 32. The outboard liner rim 42 corresponds with the label rim 34 and surrounds the central liner and label tabs.

As shown in FIG. 3, the diecut liner tab 40 improves the ability to easily excise the label tab 32 from the main label bonded to the container. Since the label and liner tabs define a two-ply lamination, and the liner tab includes a perimeter diecut, the label tab 32 which is integrally formed with the label rim in a substantially imperforate configuration therewith may be readily torn from the surrounding label rim 34 around the cleanly cut perimeter of the liner tab 40. The liner tab 40, itself, is cleanly separated from its surrounding liner rim 42 along the liner diecut 38 provided therefor.

The two-ply configuration of the laminated label and liner tabs provides increased rigidity thereof, with the liner tab reinforcing the label tab and permitting a relatively clean tear of the label tab from the surrounding label rim. Since the back of the liner tab 40 contains no adhesive, it permits removal of the overlying label tab 32 from the container, with the label rim 34 remaining permanently bonded to the container. The container may then be suitably discarded without concern for leaving any patient confidential information on the container, since the label tab has firstly been removed from the container.

Figure 4:
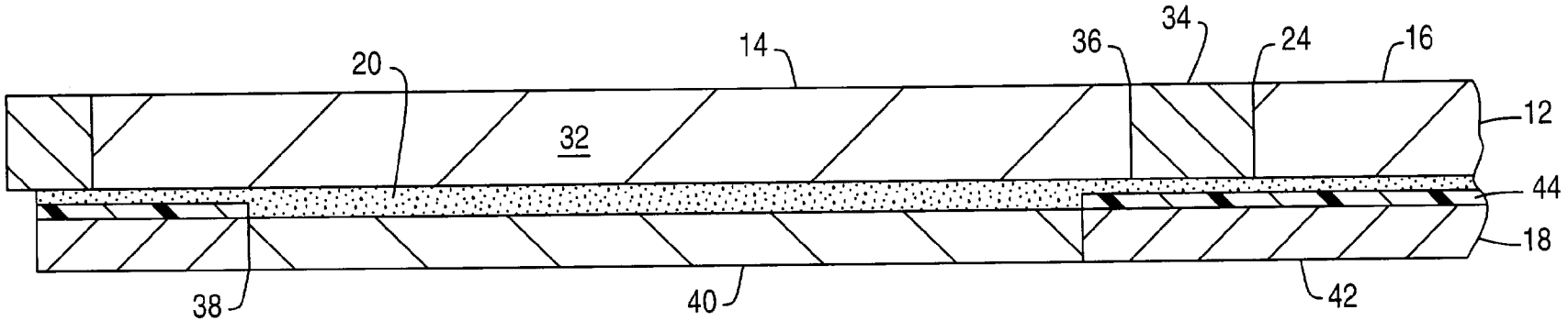
FIG. 4 is a transverse sectional view of a portion of the script illustrated in FIG. 1 and taken along line 4—4.

As illustrated in FIGS. 2–4, the tab slits 36 are preferably spaced outboard from the diecut liner tab 40 to prevent direct alignment between the slits and liner diecut. The tab slits 36 and liner diecut 38 are preferably created using corresponding die cutting tools on opposite sides of the laminate to improve the accuracy of their placement in the laminate and maintain the structural integrity of the laminate. If the slits and liner diecut were aligned with each other and formed with a single tool from one side of the laminate, some of the adhesive between the two sheets might be pushed to the surface of the laminate which could lead to sticking together of two laminate sheets and double feeding or jamming in the laser printer. Since the pressure sensitive adhesive is preferably a rubber or acrylic adhesive, it is heat-softened by the hot fusion roller in the laser printer, and it is undesirable to have such heat-softened adhesive exposed at the slits or diecuts in the laminate. The offset slits and liner diecuts eliminates these problems.

As illustrated in cross section in FIG. 4, the release liner 18 may have any conventional configuration such as super-calendered kraft (SCK) paper which is thin and smooth and provided with a coating of a silicone release agent 44. In the preferred embodiment illustrated in FIGS. 3 and 4, the liner rim 42 includes on its front side the coating of release agent for forming a removable bond with the pressure sensitive adhesive 20 on the back side of the label rim 34. The liner tab 40 is preferably devoid of the release agent on its front side opposite to the back side of the label tab 32 for forming a permanent bond with the back side of the label tab by the adhesive disposed therebetween.

In this way, the label tab 32 and liner tab 40 provide an integrated, two-ply laminate increasing the overall rigidity and stiffness thereof for permitting easy removal from the main label attached to the container as shown in FIG. 3. Since all the confidential information 30 may be placed on the label tab 32 illustrated in FIG. 3, only the main label 14 illustrated in FIG. 1 need include the excisable tab 32 configured therein. The secondary label may have any suitable form without the additional complexity of introducing the excisable tab therein.

Figure 5:
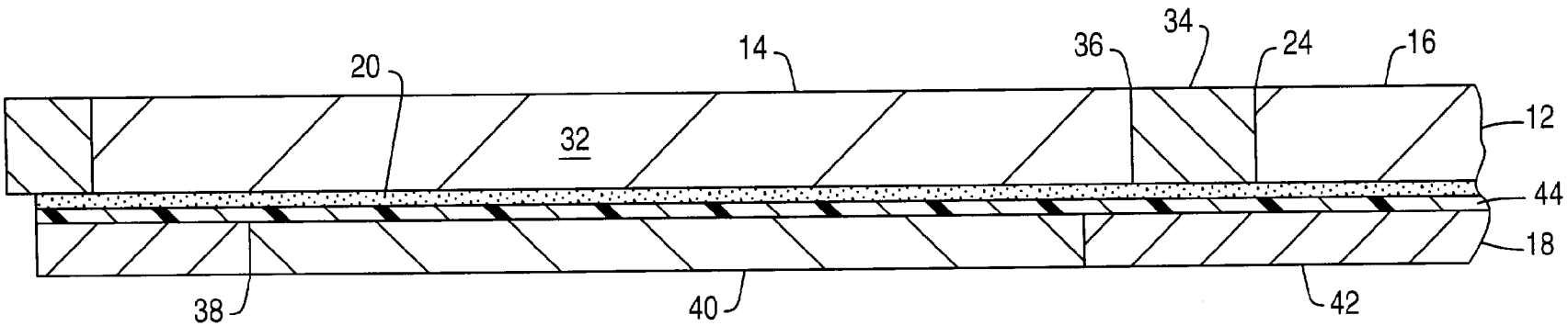
FIG. 5 is a transverse sectional view, like FIG. 4, of the script in accordance with an alternate embodiment.

FIG. 5 illustrates an alternate embodiment which is substantially identical to the embodiment illustrated in FIGS. 1–4, except that both the liner rim 42 and tab 40 include the coating of release agent 44 for forming a removable bond with both the label rim 34 and tab 32, correspondingly, at the pressure sensitive adhesive laminated therebetween. The label and liner tabs 32,40 still form a two-ply lamination for permitting their combined removal from the main label in the same manner illustrated in FIG. 3, with the bond between the two tabs being weaker than in the permanent bond configuration illustrated in FIG. 4.

However, in this configuration the label tab 32 removed from the main label may then be adhesively bonded to another object by simply removing the liner tab 40 therefrom. In this way, the customer may keep a convenient record of drug transactions by simply transferring the removed label tabs to a common record sheet for filing.

Figure 6:
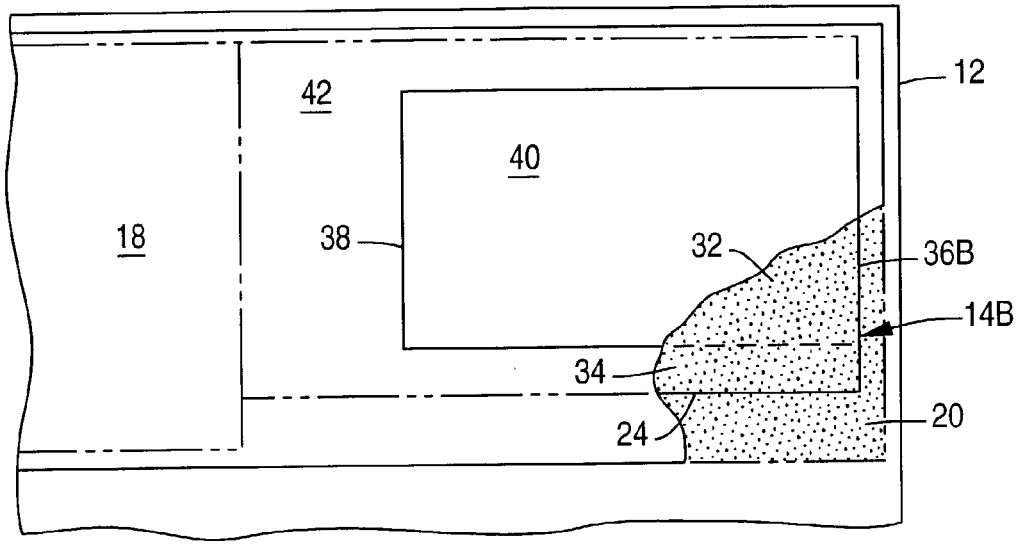
FIG. 6 is a partly sectional, back side view of a portion of the script illustrated in FIG. 2 in accordance with an alternate embodiment.

FIG. 6 illustrates another embodiment wherein the label tab 32 is relocated to one side of the face sheet so that the label diecut 24 and the liner diecut 38 may be aligned along one edge. In this way, the tab slit, designated 36B, may be aligned with or coextensive with the liner diecut 38 at one side or edge of the main label, designated 14B.

In this configuration, when the main label is removed from the liner 18 and bonded to the pharmaceutical container, a generally U-shaped, three-sided label rim is permanently adhesively bonded to the container. The fourth side of the rim in the embodiment illustrated in FIG. 3 is eliminated, which permits direct access to the edge of the liner tab 40 without interference by the label rim. This exposed edge of the liner tab may then be used for peeling away the label and liner tabs from the container, with the label tab being torn from the label rim along the corresponding three edges of the label tab.

Figure 7:
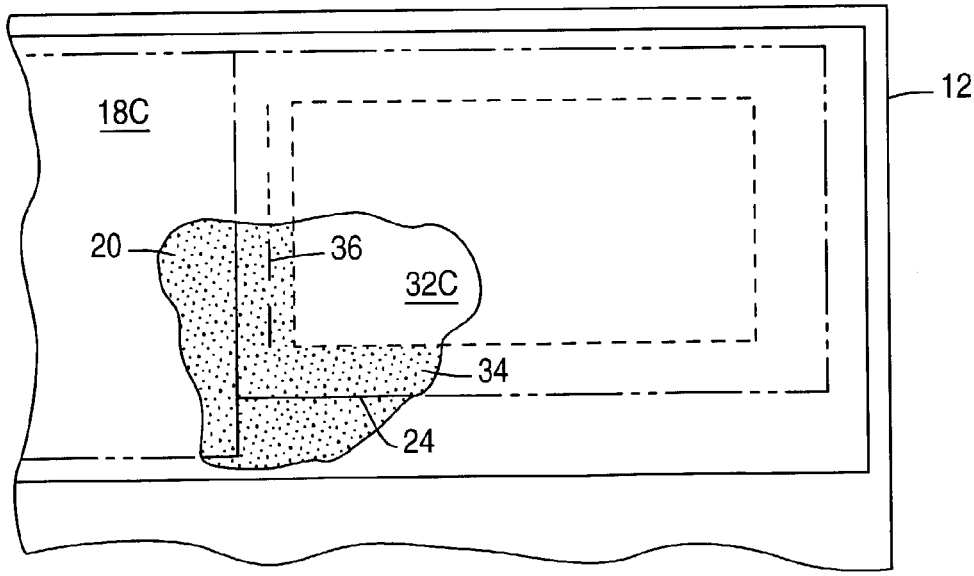
FIG. 7 is a partly sectional, back side view of a portion of the script illustrated in FIG. 2 in accordance with another embodiment.

FIG. 7 illustrates yet another embodiment of the pharmacy script in which the liner, designated 18C, is imperforate, without the diecuts in the previous embodiments. Correspondingly, the label tab, designated 32C, is substantially devoid of the adhesive 20, which adhesive remains around the label rim 34 forming the removable bond with the release liner 18C.

The removal slits 36 may also be used in this embodiment and located close to the edge of the label tab 32C within the area of the adhesive 20, or alternatively in the adhesive void. The label tab 32C is devoid of the adhesive inboard from the slits 36. The adhesive at the slits 36 ensures structural integrity of the face sheet, yet permits initiation of the tearing removal of the label tab 32C thereat.

Since the label tab 32C is itself devoid of the adhesive, it may be removed with its surrounding label rim 34 in the main label and permanently bonded to the pharmaceutical container by the perimeter adhesive. The liner 18C remains with the script, and is not required for preventing bonding of the label tab 32C with the pharmaceutical container.

The pharmaceutical label script disclosed above in various embodiments maintains initial integrity of the laminated script for being printed in a laser printer without concern for heat-softening of the adhesive, or premature liberation thereof at diecuts. Confidential patient information may be isolated in the label tab of the main label, with that tab being as large as required for containing all necessary confidential information.

The label rim is relatively narrow and surrounds the label tab with sufficient surface area for permanently bonding the main label to the pharmaceutical container in use. The permanent bond of the main label ensures that the main label cannot be accidentally or prematurely removed from the container. Yet, with intentional removal of the label tab from the main label the main label is necessarily torn along the perimeter of the label tab rendering conspicuous the damage thereto and preventing unauthorized reuse of the label on a different container without detection.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

I claim:

1. A pharmaceutical script comprising:

a face sheet including a removable label defined by a perimeter diecut;

said label including an integral excisable tab spaced inboard from a surrounding rim, and said tab includes a slit along one edge thereof;

said label tab being integrally formed with said label rim in a substantially imperforate configuration therewith for permitting tearing of said label tab from said label rim to excise said tab from said rim;

a liner laminated to said face sheet by an adhesive forming a removable bond between said label rim and said liner; and said label and tab are removable together from said liner to expose adhesive on said label rim, without adhesive being exposed on said tab, and said exposed adhesive on said rim borders said excisable tab without exposed adhesive.

2. A method of using said script according to claim 1 comprising:

printing confidential information on said label tab;

removing said label and printed tab from said liner;

adhering said label and printed tab to a pharmaceutical container to expose to view said confidential information; and excising said printed tab from said label and container commencing at said slit to remove said confidential information from said container.

3. A script according to claim 1 wherein said liner includes a diecut spaced inboard from a perimeter thereof to define a liner tab corresponding substantially in size and configuration with said label tab, and a liner rim corresponding with said label rim.

4. A script according to claim 3 wherein said tab slit as spaced outboard from said liner tab.

5. A script according to claim 3 wherein said tab slit is coextensive with said liner diecut.

6. A script according to claim 3 wherein:

said liner rim includes a coating of a release agent for forming a removable bond with said adhesive on said label rim; and said liner tab is devoid of said release agent opposite said label tab for forming a permanent bond with said label tab by said adhesive therebetween.

7. A script according to claim 3 wherein said liner rim and tab include a coating of a release agent for forming a removable bond with both said label rim and tab at said adhesive therebetween.

8. A script according to claim 3 wherein said face sheet includes a plurality of removable labels laminated in common to said liner by said adhesive, with a single label having said excisable tab.

9. A script according to claim 8 wherein said face sheet further comprises an integral form sheet extending from said labels and liner.

10. A pharmaceutical script comprising:

a face sheet including a removable label defined by a perimeter diecut;

said label including an integral excisable tab spaced inboard from a surrounding rim, and said tab includes a slit along one edge thereof;

an imperforate liner laminated to said face sheet by an adhesive forming a removable bond between said label rim and said liner, and said label tab is substantially devoid of said adhesive; and said label and tab are removable together from said liner to expose adhesive on said label rim, without adhesive being exposed on said tab.

11. A script according to claim 10 wherein said label tab is devoid of said adhesive inboard of said slit.

12. A method of using said script according to claim 3 comprising:

printing confidential information on said label tab;

removing said label and printed tab from said liner;

adhering said label and printed tab to a pharmaceutical container to expose to view said confidential information; and excising said printed tab from said label and container commencing at said slit to remove said confidential information from said container.

13. A method according to claim 12 wherein:

said tab slit is spaced outboard from said liner tab; and said label tab is torn from said label rim around the perimeter of said liner tab, and said liner tab is cleanly separated from said liner rim along said liner diecut.

14. A pharmaceutical script comprising:

a unitary face sheet having a plurality of removable labels laminated to a common release liner by an adhesive therebetween, and further including a form sheet extending below said labels and liner;

a main one of said labels including a central label tab spaced inboard from a surrounding label rim, and said label tab includes a slit along one edge thereof;

said liner includes a diecut spaced inboard from a perimeter thereof to define a liner tab corresponding with said label tab, and a liner rim corresponding with said label rim; and wherein said liner rim and tab include a coating of a release agent for forming a removable bond with both said label rim and tab at said adhesive therebetween.

15. A method of using said script according to claim 14 comprising:

printing confidential information on said label tab;

removing said main label and printed tab from said liner;

adhering said main label and printed tab to a pharmaceutical container to expose to view said confidential information; and excising said printed tab from said main label and container commencing at said slit to remove said confidential information from said container.

16. A pharmaceutical script comprising:

a unitary face sheet having a plurality of removable labels laminated to a common release liner by an adhesive therebetween, and further including a form sheet extending below said labels and liner;

a main one of said labels including a central label tab spaced inboard from a surrounding label rim, and said label tab includes a slit along one edge thereof;

said liner includes a diecut spaced inboard from a perimeter thereof to define a liner tab corresponding with said label tab, and a liner rim corresponding with said label rim;

said liner rim includes a coating of a release agent for forming a removable bond with said adhesive on said label rim; and said liner tab is devoid of said release agent opposite said label tab for forming a permanent bond with said label tab by said adhesive therebetween.

17. A pharmaceutical script comprising:

a unitary face sheet having a plurality of removable labels laminated to a common release liner by an adhesive therebetween, and further including a form sheet extending below said labels and liner;

a main one of said labels including a central label tab spaced inboard from a surrounding label rim, and said label tab includes a slit along one edge thereof;

said liner includes a diecut spaced inboard from a perimeter thereof to define a liner tab corresponding with said label tab, and a liner rim corresponding with said label rim;

said liner rim includes a coating of a release agent for forming a removable bond with said adhesive on said label rim;

said liner tab is devoid of said release agent opposite said label tab for forming a permanent bond with said label tab by said adhesive therebetween; and wherein said tab slit is spaced outboard from said liner tab.

18. A method of using said script according to claim 17 comprising:

printing confidential information on said label tab;

removing said main label and printed tab from said liner;

adhering said main label and printed tab to a pharmaceutical container to expose to view said confidential information; and excising said printed tab from said main label and container commencing at said slit to remove said confidential information from said container.

19. A method according to claim 18 wherein said label tab is torn from said label rim around the perimeter of said liner tab, and said liner tab is cleanly separated from said liner rim along said liner diecut.

* * * * *